US009624025B2

(12) United States Patent
Bala et al.

(10) Patent No.: US 9,624,025 B2
(45) Date of Patent: Apr. 18, 2017

(54) PIPETTE FOR USE WITH A PIPETTE TIP

(75) Inventors: Jan Bala, Pultusk (PL); Tomasz Strzelczyk, Grodzisk Mazowiecki (PL)

(73) Assignee: Corning Incorporated, Corning, NY (US)

( * ) Notice: Subject to any disclaimer, the term of this patent is extended or adjusted under 35 U.S.C. 154(b) by 643 days.

(21) Appl. No.: 14/119,914

(22) PCT Filed: May 30, 2012

(86) PCT No.: PCT/PL2012/000040

§ 371 (c)(1),
(2), (4) Date: Nov. 25, 2013

(87) PCT Pub. No.: WO2012/165982

PCT Pub. Date: Dec. 6, 2012

(65) Prior Publication Data

US 2014/0086807 A1 Mar. 27, 2014

(30) Foreign Application Priority Data

May 31, 2011 (PL) ..... 395078

(51) Int. Cl.
*B01L 3/02* (2006.01)
*B65D 83/00* (2006.01)

(52) U.S. Cl.
CPC ..... *B65D 83/0033* (2013.01); *B01L 3/0279* (2013.01)

(58) Field of Classification Search
CPC ..... B01L 3/02; B01L 3/021; B01L 3/0224; B01L 2200/04
See application file for complete search history.

(56) References Cited

U.S. PATENT DOCUMENTS

| | | | |
|---|---|---|---|
| 3,991,617 | A | 11/1976 | Marteau d'Autry |
| 6,833,114 | B1 | 12/2004 | Christen |
| 6,923,938 | B2 | 8/2005 | Cote et al. |
| 6,997,067 | B2 | 2/2006 | Viot |
| 7,264,779 | B2 | 9/2007 | Viot |
| 2003/0159525 | A1 | 8/2003 | Viot |
| 2007/0056391 | A1 | 3/2007 | Karbowniczek |

FOREIGN PATENT DOCUMENTS

| | | | |
|---|---|---|---|
| EP | 0155087 | A2 | 9/1985 |
| FR | 2287941 | A1 | 5/1976 |
| JP | 2005506175 | A | 3/2005 |

(Continued)

OTHER PUBLICATIONS

Search Report dated Jul. 28, 2011 in Parent application PL 395078.

(Continued)

*Primary Examiner* — Jan Ludlow
(74) *Attorney, Agent, or Firm* — Susan S. Wilks; John P. Ciccarelli

(57) ABSTRACT

A pipette (110) includes an ejector member (140) with an ejector end (142) configured to be moved from the retracted position (147*a*) to the extended position (147*b*) to eject a gripped pipette tip (120) from an end portion (132) of the body (130) of the pipette (110). The pipette (110) further includes an adjustment device (160) configured to adjust the extended position (147*b*) of the ejector end (142) with respect to the body (130) and a lock device (200) configured to selectively inhibit operation of the adjustment device (160) to adjust the extended position (147*b*) of the ejector end (142).

13 Claims, 6 Drawing Sheets

(56) References Cited

FOREIGN PATENT DOCUMENTS

| | | | |
|---|---|---|---|
| PL | 200761 | B1 | 2/2005 |
| PL | Ru 64699 | Y | 4/2009 |
| WO | 96/37302 | A1 | 11/1996 |
| WO | 0157490 | A1 | 8/2001 |
| WO | 2008060171 | A2 | 5/2008 |

OTHER PUBLICATIONS

International Search Report dated Jan. 10, 2012 in parent International Application PCT/PL2012/000040.
CN201280026672.9 Search Report.
US Equivalent to CN1419478 Cited in Search Report.
Patent Office of the China State Intellectual Property Office—English Translation of First Office Action Mailed Nov. 4, 2014. CN Application No. 201280026672.9; Filed on Nov. 29, 2013; 9 Pages.
Patent Office of the China State Intellectual Property Office—English Translation of Second Office Action Mailed Jul. 20, 2015. CN Application No. 201280026672.9; Filed on Nov. 29, 2013; 4 Pages.
Patent Office of the China State Intellectual Property Office—English Translation of Third Office Action Mailed Apr. 26, 2016. CN Application No. 201280026672.9; Filed on Nov. 29, 2013; 5 Pages.
Japan Patent Office—English Translation of Office Action Mailed Mar. 22, 2016. JP Application No. 2014-513472; Filed Dec. 2, 2013; 4 Pages.

PIPETTE FOR USE WITH A PIPETTE TIP

FIELD

The present invention relates generally to pipettes and, more particularly, to pipettes for transferring a quantity of liquid with a pipette tip and methods.

BACKGROUND

It is known to provide a pipette configured to grasp a pipette tip to transfer a quantity of liquid with the pipette tip. Once the quantity of liquid is transferred, the conventional pipette is known to include an ejector to eject the pipette tip from the pipette. It is important to provide an ejector that is appropriately fitted to accommodate the particular size and design of the desired pipette and/or pipette tip. If inappropriately sized, a new ejector must be located and fitted to accommodate the particular combination of features presented by the pipette and/or pipette tip. As such, there is a need to provide ejectors that may be quickly adjusted to the appropriate size, easily removed for possible servicing or replacement with another appropriate ejector design, and lock the adjusted position of the ejector member to prevent inadvertent change of an optimum adjusted position.

U.S. Pat. No. 7,264,779 to Viot, hereinafter Viot, discloses a known pipette. As shown in FIG. 1 of Viot, the pipette includes a control button 12, an actuator 14, a connection screw 16 and a knurled wheel 18. The pipette of Viot further includes an ejector rod 20 for separating a cone that is fixed to the pipette. As shown in FIG. 11 of Viot, at its top end, the ejector rod 20 presents a top vertical duct 52 extending to a notch 56 extending horizontally. The knurled wheel 18 can be received in the notch 56 and includes a central threaded bore for forming a screw-and-nut connection with the shank 46 of a screw 16. The screw 16 also has a male coupling portion 38 that may be received in a female coupling portion 22 of the actuator. Col. 5, lines 9-12 discloses a bayonet connection may be used to connect the ejector rod 20 to the actuator 14. Viot, however, fails to disclose a lock device for inhibiting adjustment of the extended position of the ejector rod. As such, the design of Viot promotes inadvertent adjustment of the ejector rod 20 after a desired adjustment is achieved.

U.S. Pat. No. 6,833,114 to Christen et al., hereinafter Christen et al., discloses another pipette with an ejector device 6 including an ejector mechanism 16, 16' which can be displaced to eject a tip 8 from the pipette. The ejector device 6 includes a device for adjusting position 24, 24', 33, 33', 39, 39' which is arranged in such a way that it is possible to modify the limit position reached by an ejection end 22, 22' of the ejector device at the end of a stroke. The device for adjusting position 24, 24' involves discrete adjustment positioning of the ejection end to discrete positions without the ability to maintain an adjusted position between the predetermined discrete positions defined by the engagement between the notches 31' and the bump 32" illustrated in FIG. 5. The devices for adjusting position 39, 39' illustrated in FIGS. 7 and 8 likewise involve discrete adjustment positioning of the ejection end in discrete positions. FIGS. 6 and 9 disclose devices 33, 33' including a thread 35, 35'. However, like Viot, Christen et al. fails to disclose a lock device for inhibiting adjustment of the extended position of the ejector rod. As such, Christen et al. likewise promotes inadvertent adjustment of the ejector rod 20 after a desired adjustment is achieved.

From Polish patent application No. P-381 071 and from international patent application No. PCT/PL2007/000077 is known an exchangeable tip ejection device in a pipette built of a handle 1 and a nozzle 2 and of, coupled with them, a pipetting push-button and a drawing up and discharging mechanism. Said ejection device comprises an ejector push-button 3 seated in the upper part of the pipette handle 1, an ejector 4 by its lower end seated onto the pipette nozzle 2 and an assembly for continuous adjustment of the ejector length, which assembly for continuous adjustment of the ejector length is arranged between the ejector push-button 3 and the ejector 4. The assembly for continuous adjustment of the ejector length is the connection of a "turnbuckle" type. The ejector 4 comprises an ejector rod 6 and an ejector arm 9, whereas the ejector rod 6 is coupled with the ejector push-button 3, the ejector arm 9 is seated by its lower end onto the pipette nozzle 2, and the ejector rod 6 and the ejector arm 9 are coupled with each other with formation the cylindrical joint of the axis of rotation perpendicular to the longitudinal axis X of the pipette nozzle 2.

As such, there is a need to provide an infinitely adjustable ejection end that can be locked in a desired position. There is also a need to incorporate the lock into an actuator member to reduce parts and simplify the lock design.

There is also a need to provide an ejection mechanism that may provide audible and/or vibrational feedback to indicate when a connected position is achieved between the ejection mechanism and the body of the pipette.

There is also a need to provide at least one stop to limit adjustment of the extended position of the ejector end with respect to the body.

SUMMARY

The following presents a simplified summary of the disclosure in order to provide a basic understanding of some example aspects described in the detailed description.

In one example aspect, a pipette is provided for use with a pipette tip. The pipette includes a body with an end portion. The pipette further includes an ejector member including an ejector end configured to reciprocate between a retracted position and an extended position with respect to the body. The end portion of the body is configured to releasably grip the pipette tip when the ejector end is oriented in the retracted position. A movement of the ejector end from the retracted position to the extended position is configured to eject a gripped pipette tip from the end portion of the body. The pipette further includes an adjustment device configured to adjust the extended position of the ejector end with respect to the body and a lock device configured to selectively inhibit operation of the adjustment device to adjust the extended position of the ejector end.

In accordance with one embodiment of the aspect, the pipette further comprises a link member, wherein the adjustment device adjustably couples the ejector member relative to the link member to adjust the extended position of the ejector end.

In accordance with another embodiment of the aspect, the lock device is configured to substantially prevent operation of the adjustment device from adjusting the extended position by substantially preventing a relative rotation of the link member with respect to the body.

In accordance with another embodiment of the aspect, the lock device is configured to be coupled to the link member to substantially prevent operation of the adjustment device from adjusting the extended position by substantially preventing a relative rotation of the link member with respect to the body. In this embodiment, the lock device is configured to be uncoupled from the link member to allow operation of the adjustment device by permitting a relative rotation of the link member with respect to the body.

In accordance with still another embodiment of the aspect, an interface between the adjustment device and the link member is configured to removably couple the ejector member with respect to the link member.

In accordance with yet another embodiment wherein interface comprises a bayonet joint.

In accordance a further embodiment, the interface is configured to inhibit a rotational movement of the adjustment device with respect to the link member.

In accordance with another embodiment, the lock device comprises an actuator member configured to be pressed to move the ejector end from the retracted position to the extended position to eject the gripped pipette tip from the end portion of the body.

In accordance with yet another embodiment, the adjustment device includes a threaded portion configured to engage a threaded portion of the ejector member. In this embodiment, an adjustment rotation of the adjustment device relative to the ejector member is configured to adjust the extended position of the ejector end with respect to the body.

In accordance with still another embodiment, the adjustment device includes at least one stop configured to limit an adjustment of the extended position of the ejector end with respect to the body.

In accordance with yet another embodiment, the pipette includes a bayonet joint configured to removably couple the ejector member with respect to the body.

In accordance with another embodiment, the lock device is configured to be coupled with respect to the body to permit a translation of the lock device with respect to the body.

In accordance with still another embodiment, the lock device is configured to be coupled with respect to the body to inhibit a rotation of the lock device with respect to the body.

In another example aspect, a pipette is provided for use with a pipette tip. The pipette includes a body with an end portion and an ejector member. The ejector member includes an ejector end configured to reciprocate between a retracted position and an extended position with respect to the body. The end portion of the body is configured to releasably grip the pipette tip when the ejector end is oriented in the retracted position. A movement of the ejector end from the retracted position to the extended position is configured to eject a gripped pipette tip from the end portion of the body. The pipette further includes a link member and an adjustment device attached to the link member. The adjustment device includes a threaded portion configured to engage a threaded portion of the ejector member. An adjustment rotation of the adjustment device relative to the ejector member is configured to rotate the link member and adjust the extended position of the ejector end with respect to the body. The pipette further includes a lock device configured to be coupled to the link member to substantially prevent the adjustment rotation of the adjustment device by substantially preventing a relative rotation of the link member with respect to the body. The lock device is also configured to be uncoupled from the link member to allow the adjustment rotation of the adjustment device by permitting a relative rotation of the link member with respect to the body.

In accordance with one embodiment, an interface between the adjustment device and the link member is configured to removably couple the ejector member with respect to the link member.

In accordance with another embodiment, the lock device comprises an actuator member configured to be pressed to move the ejector end from the retracted position to the extended position to eject the gripped pipette tip from the end portion of the body.

In accordance with still another embodiment, the adjustment device includes at least one stop configured to limit an adjustment of the extended position of the ejector end with respect to the body.

In accordance yet another embodiment, the lock device is configured to be coupled with respect to the body to permit a translation while inhibiting a rotation of the lock device relative to the body.

BRIEF DESCRIPTION OF THE DRAWINGS

These and other features, aspects and advantages of the present disclosure are better understood when the following detailed description is read with reference to the accompanying drawings, in which.

DETAILED DESCRIPTION

Figure 1:
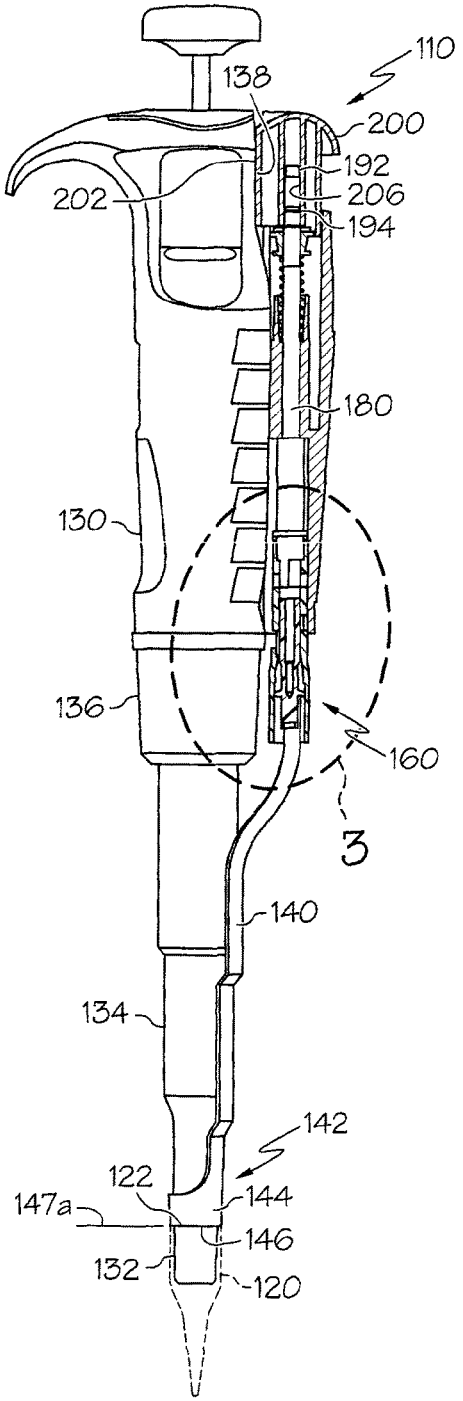
FIG. 1 illustrates a partial sectional elevation view of a pipette with an ejector member in a retracted position.

Methods will now be described more fully hereinafter with reference to the accompanying drawings in which example embodiments of the disclosure are shown. Whenever possible, the same reference numerals are used throughout the drawings to refer to the same or like parts. However, this disclosure may be embodied in many different forms and should not be construed as limited to the embodiments set forth herein.

FIG. 1 illustrates a partial sectional elevation view of a pipette 110 incorporating aspects of the disclosure. The pipette 110 can include a wide variety of configurations including various designs, sizes, shapes or functional features designed to permit transfer of a quantity of liquid with a pipette tip 120 associated with the pipette 110 in use. In some examples, a plurality of pipette devices may be linked together to independently grip a corresponding pipette tip in use. Alternatively, as shown, a single pipette may be provided that is designed grip a single pipette tip 120. The pipette 110 can comprise an automatic or manual pipette. In some examples, the pipette 110 can be provided or adjusted to provide transfer of a predetermined quantity of liquid.

The pipette 110 can include a body 130 that may provide a holding structure for a user holding the pipette 110 although the housing may alternatively be designed to be grasped by a robot or other support mechanism. The body 130 may comprise a plastic, metal or other material depending on the particular application.

The body 130 can include an end portion 132 configured to grip the pipette tip 120. In one example, end portion 132 may be designed for a friction fit with the pipette tip 120 although a snap fit, expansion device, or other connection method may be employed to allow the end portion 132 to grip the pipette tip 120.

Figure 2:
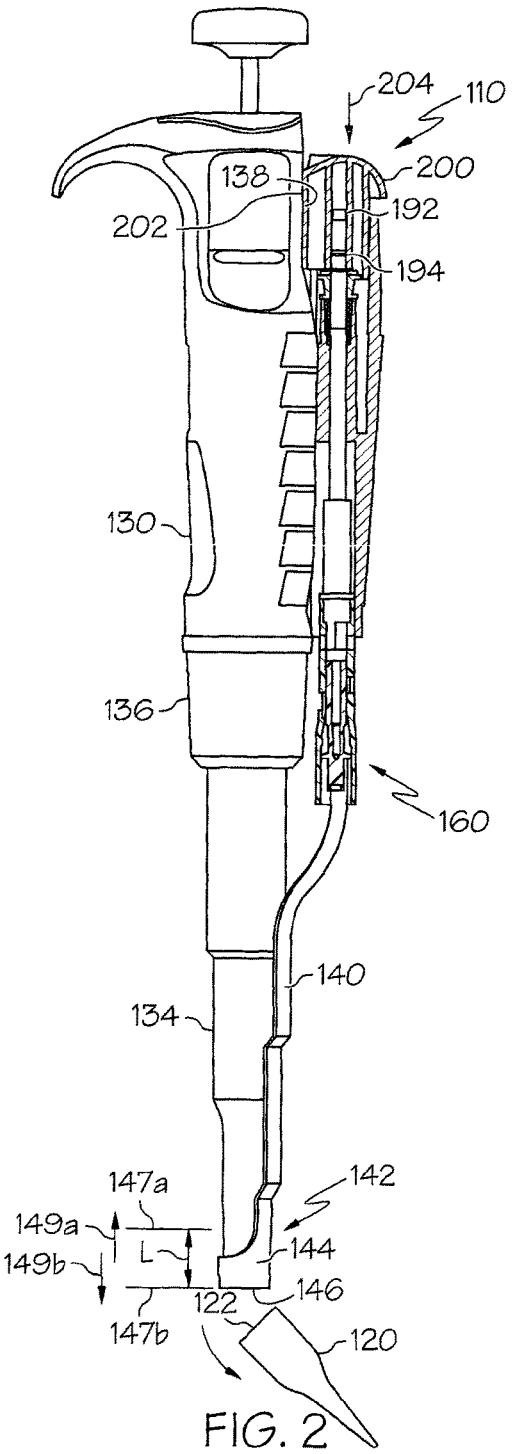
FIG. 2 schematically illustrates the pipette of FIG. 1 with the ejector member in an extended position.

As further shown in FIG. 1, the pipette 110 can further include an ejector member 140 including an ejector end 142 configured to reciprocate between a retracted position, see FIG. 1, and an extended position, see FIG. 2, with respect to the body 130. As shown in FIG. 1, the ejector end 142 can include a sleeve 144 configured to circumscribe the end portion 132. The sleeve 144 can be guided by the end portion 132 of the body 130 between the retracted and extended position and also acts to properly orient the ejector end 142 relative to the body 130 when the ejector member 140 is properly installed with respect to the body 130.

As further illustrated, the ejector end 142 can include an abutment surface 146 configured to engage a portion of the pipette tip 120 to promote ejection of the pipette tip 120 from the end portion 132 of the body 130 when moving the ejector member 140 to the extended position shown in FIG. 2. In some examples, as shown in FIG. 1, the abutment surface 146 can comprise a circumferential edge adapted to engage a circumferential edge 122 of the pipette tip 120.

As such, as shown in FIG. 1, the end portion 132 of the body 130 is configured to releasably grip the pipette tip 120 when the ejector end 142 is oriented in the retracted position. Moreover, as shown in FIG. 2, a movement of the ejector end 142 from the retracted position to the extended position is configured to eject a gripped pipette tip 120 from the end portion 132 of the body 130. Indeed, as shown, the abutment surface 146 of the sleeve 144 may engage and apply an ejection force to a circumferential edge 122 of the pipette tip 120 to eject the gripped pipette tip 120 of FIG. 1 from the end portion 132 of the body 130.

Figure 3:
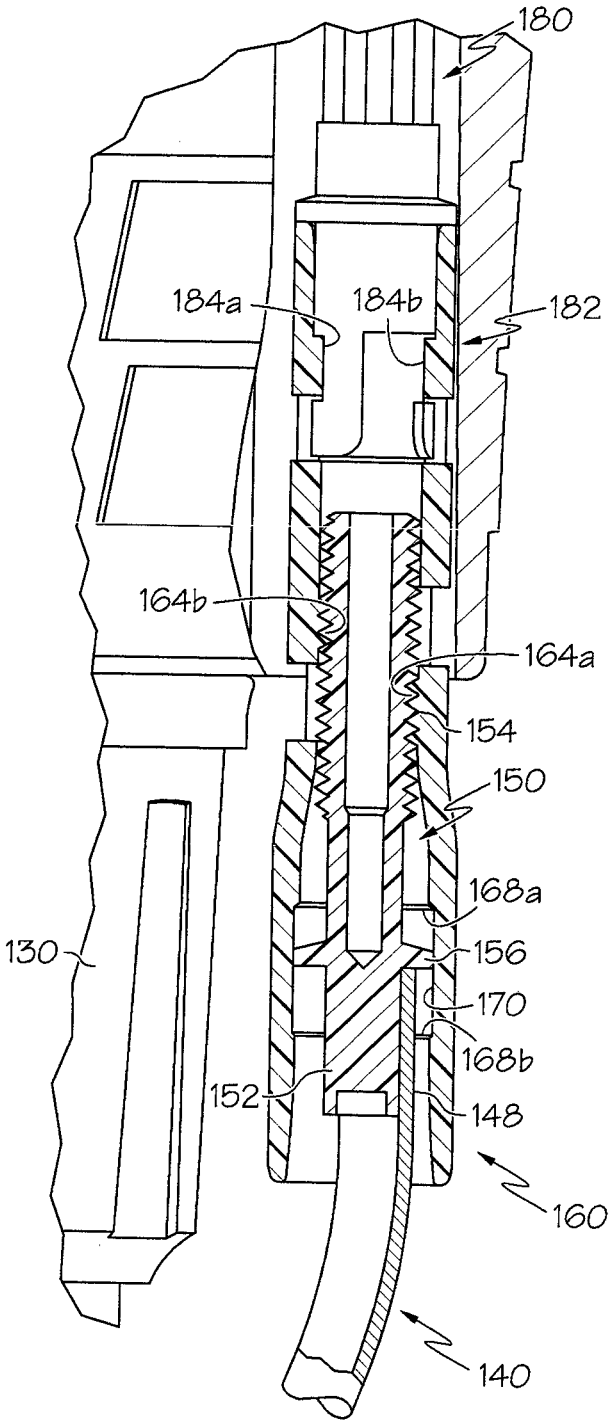
FIG. 3 is an enlarged view of portions of the pipette of FIG. 1.

FIG. 3 illustrates an enlarged view of portions of the pipette 110 of FIG. 1. As shown in FIG. 3, the ejector member 140 can also include another end portion 148 that may be crimped or otherwise attached to a coupling device 150. The coupling device 150 can include a mounting sleeve 152 that may be molded with an opposed pair of detents (not shown) configured to receive corresponding inwardly extending protrusions (not shown) of the end portion 148. As such, it is possible to fixedly attach the coupling device 150 to the end portion 148 of the ejector member 140 by crimping the end portion 148 over the mounting sleeve 152. If provided, the detents of the mounting sleeve 152 and the protrusions of the end portion 148 can interact to secure the attachment to resist relative movement between the coupling device 150 and the ejector member 140. In some examples, the end portion 148 of the ejector member 140 may be formed integrally with the features of the coupling device 150. However, providing the ejector member 140 and coupling device 150 different components that are fixedly attached together can allow the components to be fabricated from different materials and/or facilitate fabrication techniques. In one example, the ejector member 140 can comprise stainless steel although plastic or another material type may be used in further examples. In further examples, the coupling device 150 may comprise a plastic material such as polyoxymethylene (POM) although other materials may be used in further examples.

The pipette 110 can further include an adjustment device 160 configured to adjust the extended position of the ejector end 142 with respect to the body 130. For example, as shown in FIG. 1, in the retracted position, the abutment surface 146 achieves the retracted position 147*a*. As shown in FIG. 2, in the extended position, the abutment surface 146 achieves the extended position 147*b* wherein a stroke length "L" is defined between the retracted and extended positions 147*a*, 147*b*. The adjustment device 160 is designed to shift the stroke length "L" in a direction 149*a*, or a direction 149*b*. As such, the retracted and extended positions 147*a*, 147*b* may be adjusted relative to the body 130 such that the ejector member 140 may be quickly adapted to be used with a wide range of pipette configurations and/or pipette tips.

For example, with reference to FIG. 1, the ejector member 140 may be used with another pipette including a body with a shorter arm 134 extending from a base 136 of the body 130. In such examples, the adjustment device 160 may be used to adjust the extended position of the ejector end 142 in a direction 149*a* toward the base 136. In such examples, the stroke length "L" is shifted towards the base 136 to accommodate the shorter arm 134. In further examples, the ejector member 140 may be used with another pipette including a body with a longer arm 134 extending from the base 136 of the body 130. In such examples, the adjustment device 160 may be used to adjust the extended position of the ejector end 142 in a direction 149*b* away from the base 136. In such examples, the stroke length "L" is shifted away from the base 136 to accommodate the longer arm 134.

In addition or alternatively, the adjustment device 160 may also be used to adjust the extended position of the ejector end 142 with respect to the body to accommodate alternative pipette tip designs. For example, another gripped pipette tip design may present the circumferential edge 122 closer to the base 136 of the body 130. In such examples, the adjustment device 160 may be used to adjust the extended position of the ejector end 142 in a direction 149*a* toward the base 136. In such examples, the stroke length "L" is shifted towards the base 136 to accommodate the shifting of the circumferential edge 122 closer to the base 136. In further examples, yet another gripped pipette tip design may present the circumferential edge 122 farther away from the base 136 of the body 130. In such examples, the adjustment device 160 may be used to adjust the extended position of the ejector end 142 in the direction 149*b* away from the base 136. In such examples, the stroke length "L" is shifted away from the base 136 to accommodate the shifting of the circumferential edge 122 fatter away from the base 136.

Figure 4:
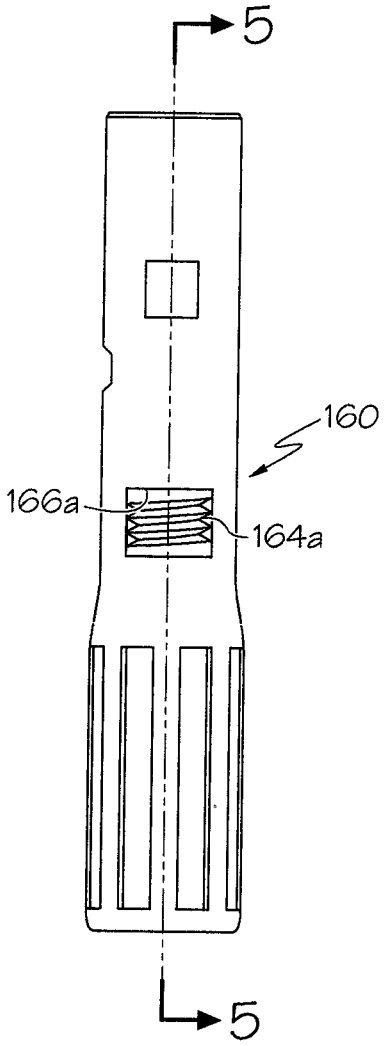
FIG. 4 is a front elevational view of an example adjustment device.
Figure 5:
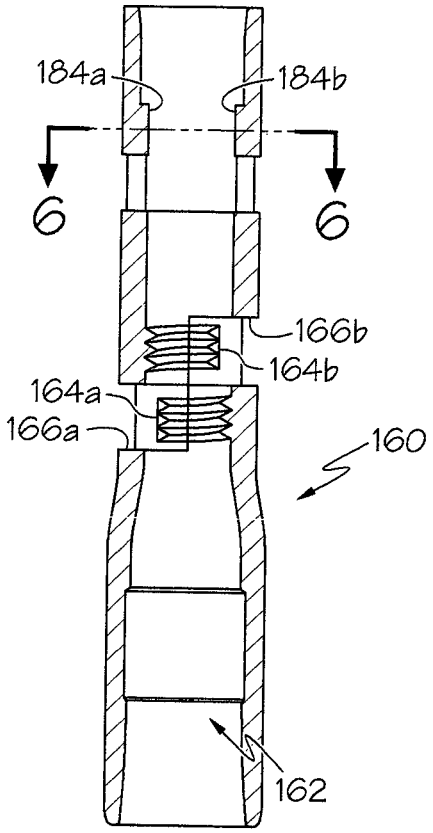
FIG. 5 is a sectional view of the adjustment device along line 5-5 of FIG. 4.
Figure 6:
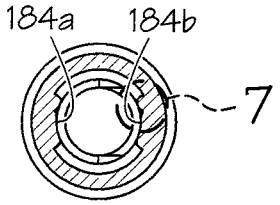
FIG. 6 is a sectional view of the adjustment device along line 6-6 of FIG. 5.
Figure 7:
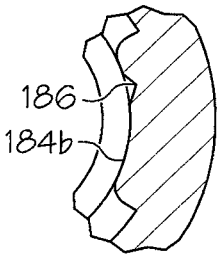
FIG. 7 is an enlarged view of a portion of FIG. 6, illustrating a groove within a protrusion of the adjustment device.
Figure 8:
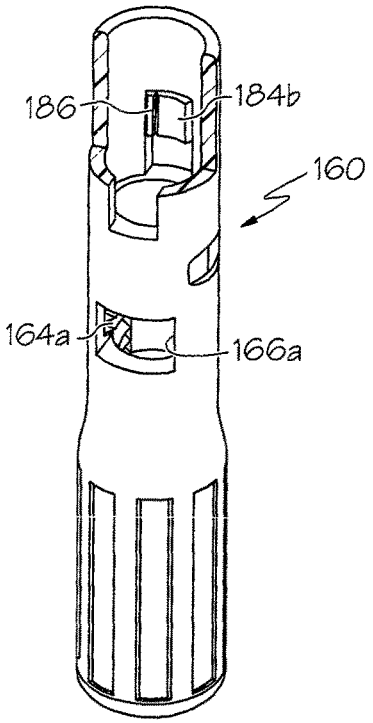
FIG. 8 is a partial sectional perspective view of the adjustment device of FIG. 4.
Figure 9:
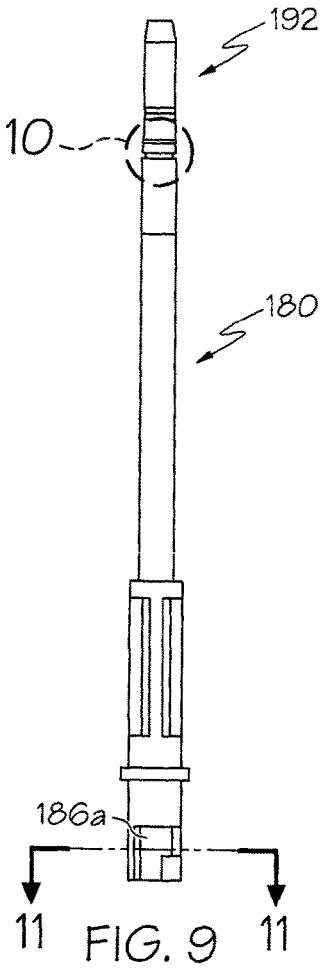
FIG. 9 is a front elevational view of an example link member.

The adjustment device 160 may include a wide range of structures configured to permit adjustment of the extended position of the ejector end 142 with respect to the body 130. For example, referring to FIG. 5, the adjustment device 160 can comprise a cylindrical sleeve with an inner passage 162. As shown in FIGS. 4, 5, and 8, the cylindrical sleeve may be provided with at least one threaded portion 164*a*, 164*b*. Although a single threaded portion may be provided, the illustrated two opposed threaded portions 164*a*, 164*b* may be provided to simplify fabrication techniques. For example, during fabrication, a molding device may be inserted through windows 166*a*, 166*b* to form the corresponding threaded portions 164*a*, 164*b*. Such formation techniques may be particularly beneficial when forming the part from a plastic material, such as polyoxymethylene (POM) although other materials may be used in further examples.

Turning back to FIG. 3, the coupling device 150 may be inserted into the inner passage 162 of the adjustment device 160 such that external threads of a threaded portion 154 are operably engaged with the threaded portions 164*a*, 164*b* of the adjustment device 160. As such, the adjustment device 160 can comprise a sleeve with an inner threaded portion configured to engage a threaded portion of the ejector member 140, such as the illustrated coupling device 150, wherein an adjustment rotation of the adjustment device 160 relative to the ejector member 140 is configured to adjust the extended position of the ejector end 142 with respect to the body 130.

The adjustment device 160 can also optionally include at least one stop 168*a*, 168*b* configured to limit an adjustment of the extended position of the ejector end 142 with respect to the body 130. For example, the at least one stop can include a first stop 168*a* and a second stop 168*b* comprising shoulders defining an expanded area 170. The coupling device 150 can include a circumferential flange 156 designed to travel within the expanded area 170. The adjustment device 160 can be adjusted to one extreme position where further adjustment is prevented by engagement of the circumferential flange 156 with the first stop 168*a*. The adjustment device 160 can also be adjusted to another extreme position where further adjustment is prevented by engagement of the circumferential flange 156 with the second stop 168*b*. The distance between the stops 168*a*, 168*b* define the extent that the extended position of the ejector end 142 can be adjusted relative to the body 130.

The pipette 110 can optionally include a link member 180. In one example, the adjustment device 160 can adjustably couple the ejector member 140 relative to the link member 180 to adjust the extended position of the ejector end 142. In one example, the ejector member 140 may be removably coupled with respect to the link member 180. For example, an interface between the adjustment device 160 and the link member 180 may be configured to removably couple the ejector member 140 with respect to the link member 180. A wide range of interface configurations may be used in accordance with aspects of the disclosure. For instance, as shown in FIG. 3, the interface 182 may comprise a bayonet joint although other interface configurations may be used in further examples.

Figure 12:
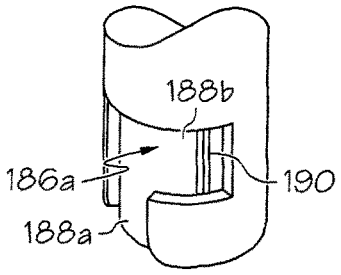
FIG. 12 is an enlarged perspective view of a portion of the link member of FIG. 9.

As shown in FIGS. 3 and 5-8, a first part of the bayonet joint can include a pair of protrusions 184*a*, 184*b* extending within the inner passage 162 of the adjustment device 160. As further illustrated in FIGS. 3, 9, 11 and 12, a second part of the bayonet joint can include a pair of opposed L-shaped slots 186*a*, 186*b*. As shown in FIG. 12, each L-shaped slot includes an axial portion 188*a* and a radial portion 188*b* in communication with the axial portion 188*a*. At least one or both of the radial portions 188*b* can be provided with at least one locking rib 190 or other structure configured to inhibit, such as prevent, a rotational movement of the adjustment device 160 with respect to the link member 180. For example, the locking rib 190 may be configured to engage a corresponding groove 186, see FIGS. 7 and 8, formed on one or both of the protrusions 184*a*, 184*b*.

FIGS. 1 and 2 illustrate an example of a lock device 200 configured to selectively inhibit, such as prevent, operation of the adjustment device 160 to adjust the extended position of the ejector end 142. In the illustrated example, the lock device 200 comprises an actuator member configured to be pressed to move the ejector member 140 from the retracted position to the extended position to eject the gripped pipette tip 120 from the end portion 132 of the body 130. In further examples, the lock device 200 may be constructed at a different location to inhibit operation of the adjustment device 160. However, providing the lock device 200 in the form of the illustrated actuator member can simplify the design, operation, potentially reduce modes of failure and reduce manufacturing costs.

The lock device 200 can operate in various different ways to inhibit operation of the adjustment device. For example, as illustrated, the lock device 200 may be configured to substantially prevent operation of the adjustment device 160 by substantially preventing a relative rotation of the link member 180 with respect to the body 130. If formed as the illustrated actuator member, the lock device 200 can be configured to be coupled with respect to the body 130 to permit a translation of the lock device 200 with respect to the body 130. Moreover, the lock device 200 can be configured to be coupled with respect to the body 130 to inhibit a rotation of the lock device 200 with respect to the body 130. For instance, as shown in FIGS. 1 and 2, the lock device 200 can include a tongue 202 slidingly and nonrotatably received within a groove 138 defined in the body 130 of the pipette 110. Once coupled, the lock device 200 may translate along ejection direction 204 from the uncompressed position shown in FIG. 1 to the compressed position shown in FIG. 2.

Figure 10:
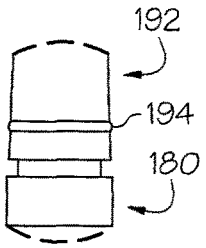
FIG. 10 is an enlarged view of portions of the link member of FIG. 9.
Figure 11:
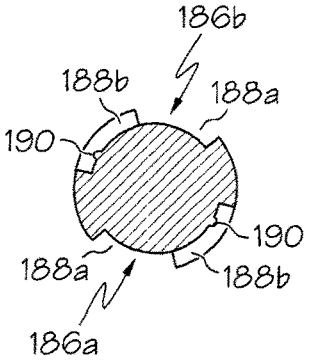
FIG. 11 is a sectional view of the link member along line 11-11 of FIG. 9.

As mentioned above, the lock device 200 can be nonrotatably coupled to the body 130. As further illustrated, the link member 180 can be nonrotatably attached to the lock device 200 such that the link member 180 is substantially prevented from rotating with respect to the body 130. For example, as shown in FIGS. 1 and 2, an end portion 192 of the link member 180 may be nonrotatably received within a socket 206 of the lock device 200. In one example, the end portion 192 may have a polygonal shape to be received in corresponding polygonal shaped socket. Alternatively, as shown, the end portion 192 may be cylindrical to be received within a cylindrical socket. Providing a cylindrical configuration can allow locking of the adjustment device 160 in an infinite number of positions. As shown in FIG. 10, the end portion 192 may include a frictional rib 194 configured to increase frictional engagement between the end portion 192 and the socket 206 of the lock device 200. As such, the frictional rib 194 can optionally be provided to further inhibit, such as prevent, relative rotation of the link member 180 with respect to the lock device 200. Once the end portion 192 of the link member 180 is nonrotatably coupled with respect to the lock device 200, the link member 180 is consequently prevented from rotating relative to the body 130 of the pipette 110.

Figure 15:
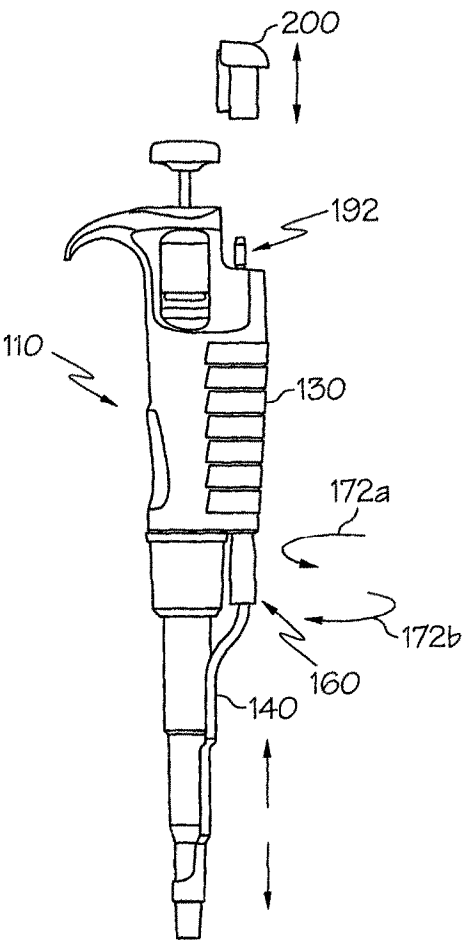
FIG. 15 illustrates a method of adjusting the extended position of the ejector end of the ejector member with respect to the body of the pipette.

It will therefore be appreciated that the lock device 200, such as the illustrated actuator member, can be configured to be coupled to the link member 180 to substantially prevent operation of the adjustment device 160 from adjusting the extended position by substantially preventing a relative rotation of the link member 180 with respect to the body 130. Moreover, the lock device 200 can be uncoupled from the link member from the link member 180 to allow operation of the adjustment device 160 by permitting a relative rotation of the link member 180 with respect to the body 130. As shown in FIG. 15, uncoupling can be achieved by completely removing the lock device 200 from the body 130 of the pipette 110. Although not shown, in further examples, the lock device 200 may be configured to be uncoupled without removing the lock device 200 from the body 130. For example, the lock device 200 may be forced into a different orientation to uncouple the link member while still remaining attached to the body 130. For example, the lock device may be tethered or otherwise connected to the body 130 to help prevent misplacement of the lock device when uncoupled from the link member.

As mentioned above, various aspects of the disclosure may be used with a wide range of configurations. For instance, in just one example, the illustrated pipette 110 can provide the adjustment device 160 that may be attached to the link member 180. As mentioned previously, an interface, e.g. bayonet joint, between the adjustment device 160 and the link member 180 may be configured to removably couple the ejector member 140 with respect to the link member 180.

As discussed, in one example, the adjustment device 160 can include the threaded portion 164*a*, 164*b* configured to engage the threaded portion 154 of the ejector member 140. An adjustment rotation of the adjustment device 160 relative to the ejector member 140 is configured to rotate the link member 180 and adjust the extended position of the ejector end 142 with respect to the body 130. In such examples, the lock device 200 can be configured to be coupled to the link member 180 to substantially prevent the adjustment rotation of the adjustment device 160 by substantially preventing a relative rotation of the link member 180 with respect to the body 130. The lock device 200 can alternatively be uncoupled from the link member 180 to allow the adjustment rotation of the adjustment device 160 by permitting a relative rotation of the link member 180 with respect to the body 130. As shown, the lock device 200 can optionally be provided as the illustrated actuator member configured to be pressed to move the ejector member 140 from the retracted position to the extended position to eject the gripped pipette tip 120 from the end portion 132 of the body 130.

Methods of using the pipette 110 will now be discussed with initial reference to the flowchart 300 shown in FIG. 16. As shown, the method can start begin at reference number 310 with a step 320 of providing the pipette 110 with the body 130 including the end portion 132, and the ejector member 140 including the ejector end 142. The pipette 110 can also be provided with the link member 180 adjustably coupled with respect to the ejector member 140, and the actuator member coupled to the link member 180 and substantially nonrotatably coupled with respect to the body 130.

As indicated by arrow 322, the method can then optionally proceed to step 330 of releasably gripping the pipette tip 120 with the end portion 132 of the body 130 when the ejector end 142 is oriented in the retracted position with respect to the body 130 as shown in FIG. 1.

As further indicated by arrow 332, the method can optionally proceed to step 340 of operating the pipette 110 to transfer a quantity of liquid with the pipette tip 120. During this step, a desired volume may be dialed into the pipette 110. The user may then move the pipette tip into fluid communication with the quantity of liquid to be transferred. The user can then trigger the pipette to draw the predetermined volume of liquid into the pipette tip 120. The quantity of liquid can then be moved to a new desired location. Once the pipette tip 120 is appropriately positioned, the user can signal the pipette 110 to dispense the liquid from the pipette tip 120 to complete the transfer of the predetermined volume of liquid.

Once the transfer is complete, the pipette 110 can be moved to a position to discard the used pipette tip. As indicated by arrow 342, and shown in FIG. 2, the method can include the step 350 of pressing the actuator member to translate the actuator member, the link member 180 and the ejector member 140 along the ejection direction 204 relative to the body 130 to move the ejector end 142 from the retracted position, shown in FIG. 1, to an extended position, shown in FIG. 2, with respect to the body 130 to eject the gripped pipette tip 120 from the end portion 132 of the body 130. As shown by arrow 352 the method can then end as indicated at 360. Alternatively, as indicated by arrow 354, the method can loop back to step 330 to proceed with another step 330 of releasably gripping another pipette tip to transfer an additional quantity of liquid.

As indicated by arrows 324, 334 the method can further include the steps 370 for adjusting the ejector member 140 at various times during the method of using the pipette 110. For example, after the step 320 of providing the pipette 110, there may be a desire to adjust the ejector member. For example, the ejector member 140 may appear too short or too long for the arm 134 of the pipette 110. In such a circumstance, the lock device 200, e.g. actuator member, may be uncoupled from the link member 180 during step 372 and as shown in FIG. 15.

Figure 16:
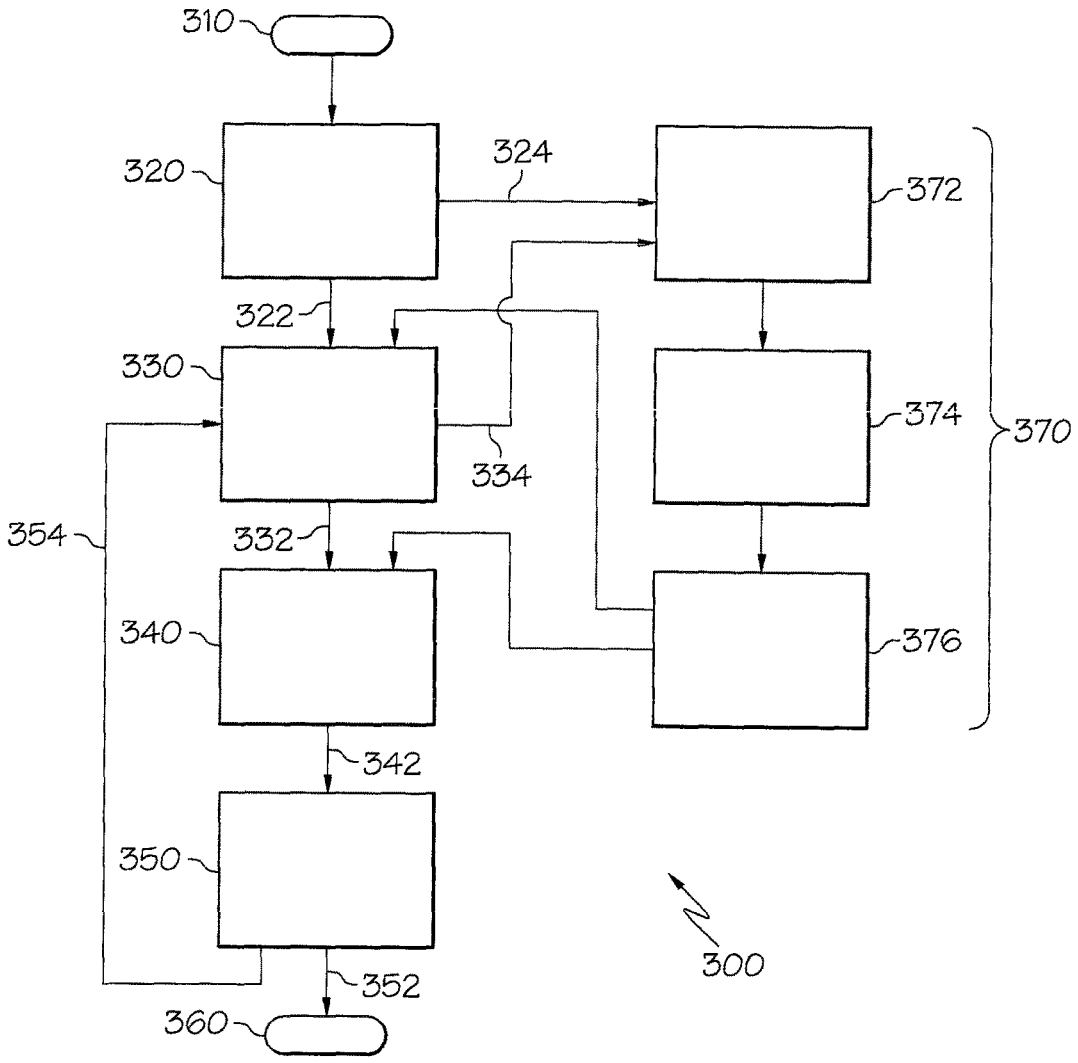
FIG. 16 is a flowchart illustrating example steps of using a pipette.

As indicated by directional arrows 172*a*, 172*b* in FIG. 15 and as represented by step 374 in FIG. 16, the extended position of the ejector end 142 may be adjusted with respect to the body 130 by an adjustment rotation of the adjustment device 160. In one example, the step of adjusting the extended position of the ejector end 142 with respect to the body 130 includes the step of rotating an adjustment device 160 together with the link member 180 relative to the ejector member 140.

As indicated by step 376, the method may further include the step of again coupling the actuator member to the link member 180 to inhibit further adjustment of the extended position of the ejector end 142 with respect to the body 130. For instance, the frictional engagement between the end portion 192 of the link member 180 and the socket 206 of the lock device 200 can substantially prevent rotation of the link member 180 and consequently operation of the adjustment device 160 to adjust the position of the ejector end 142.

Figure 14:
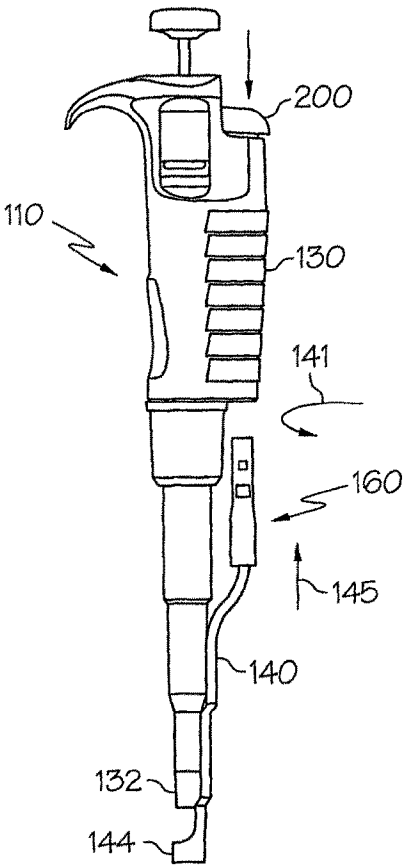
FIG. 14 illustrates a method of coupling an ejector member.
Figure 13:
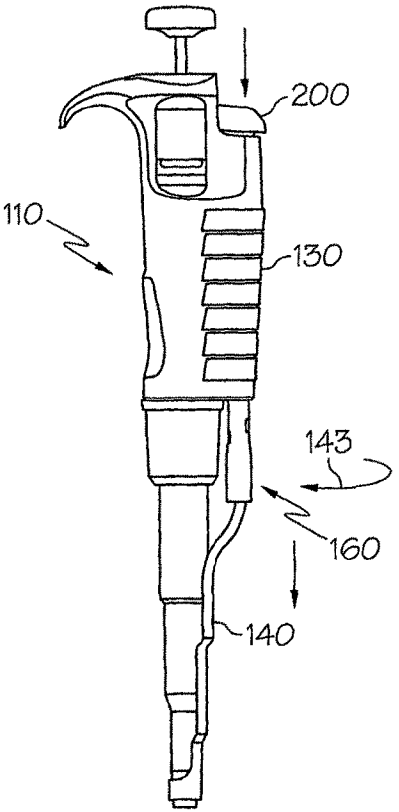
FIG. 13 illustrates a method of removing an ejector member.

As shown in FIGS. 13 and 14, the ejector member 140 can optionally be provided with a construction that allows a quick connect and/or disconnect from the body 130 of the pipette 110. For example, as shown in FIG. 14, to connect the ejector member 140, the lock device 200 may be coupled to the end portion 192 of the link member 180 to prevent an adjustment rotation of the adjustment device 160. Next, the sleeve 144 of the ejector member 140 may be aligned with the end portion 132. Then, the ejector member 140 may be moved upward in direction 145 until the protrusions 184*a*, 184*b* enter the respective axial portions 188*a* of the L-shaped slots 186*a*, 186*b*. Once fully received, the adjustment device 160 can be rotated in direction 141 relative to the link member 180 such that the protrusions 184*a*, 184*b* are seated within the respective radial portions 188*b* of the L-shaped slots 186*a*, 186*b*. Once fully seated, the locking ribs 190 can be snappingly received in the grooves 186 of the protrusions 184*a*, 184*b* to couple the adjustment device 160 to the link member 180 such that an adjustment rotation of the adjustment device 160 results in a corresponding rotation of the link member 180. Such coupling of the coupling the adjustment device 160 to the link member 180 allows locking of the adjustment device 160 from an adjusting rotation. Thus, the snapping connection between the locking rib 190 and the groove 186 can provide sufficient resistance to prevent an adjusting rotation when the link member is locked. The snapping connection also permits an audible sound and/or sensory vibration that allows the user to confirm positive locking of the ejector member 140 to the link member 180.

At the same time, upon application of sufficient torque, the locking ribs 190 may be snapped out of the grooves 186 by rotating in the opposite direction 143 shown in FIG. 13. Upon sufficient rotation in the opposite direction 143, the protrusions 184*a*, 184*b* can be backed out of the L-shaped slots 186*a*, 186*b* to quickly disconnect the ejector member 140 from the body.

Features of the disclosure provide an ejector member 140 with a quick connect and/or disconnect coupling with respect to the body 130 of the pipette. As such, a wide range of ejector members 140 may be used with various pipette devices. In some examples, an ejector member 140 may be designed to be used with various pipette models. As such, a smaller inventory of ejector members 140 may be provided to service a wide range of pipette models. Moreover, the quick connect and/or disconnect feature, e.g. provided by the bayonet joint, allows quick replacement of a damaged ejector member or switching between different sized ejector members if desired.

Still further, the pipette may be provided with an adjustment device that can optionally provide a dual function of allowing adjustment of the ejector end 142 relative to the body 130 and/or allow disconnecting of the ejector member 140 from the body 130.

Still further, aspects of the disclosure allows for adjustment of the ejector end 142 and then locking the customized adjustment in place. Once locked, inadvertent adjustment of the ejector end 142 can be avoided. Still further, aspects of the disclosure can provide the locking device as the actuator member configured to be pressed to move the ejector member 140 from the retracted position to the extended position to eject the gripped pipette tip 120 from the end portion 132 of the body 130. As such, the actuator member can provide a selective locking function as well as an ejection function.

In another example aspect, a method of using a pipette tip includes the step of (I) providing the pipette with a body including an end portion. The step further includes providing the pipette with an ejector member including an ejector end, a link member adjustably coupled with respect to the ejector member, and an actuator member coupled to the link member and substantially nonrotatably coupled with respect to the body. The method further includes the steps of: (II) releasably gripping a pipette tip with the end portion of the body when the ejector end is oriented in a retracted position with respect to the body; and (III) operating the pipette to transfer a quantity of liquid with the pipette tip. The method further includes the step of: (IV) pressing the actuator member to translate the actuator member, the link member and the ejector member along an ejection direction relative to the body to move the ejector end from the retracted position to an extended position with respect to the body to eject the gripped pipette tip from the end portion of the body. After step (I) and before step (III), the method further includes the step of: (V) uncoupling the actuator member from the link member, and then adjusting the extended position of the ejector end with respect to the body, and then again coupling the actuator member to the link member to inhibit further adjustment of the extended position of the ejector end with respect to the body.

In one example, the step of adjusting the extended position of the ejector end with respect to the body includes the step of rotating an adjustment device together with the link member relative to the ejector member.

It will be apparent to those skilled in the art that various modifications and variations can be made to the present disclosure without departing from the spirit and scope of the invention. Thus, it is intended that the present invention cover the modifications and variations of this disclosure provided they come within the scope of the appended claims and their equivalents.

What is claimed is:

1. A pipette for use with a pipette tip, the pipette comprising:

a body including an end portion;

an ejector member including an ejector end configured to reciprocate between a retracted position and an extended position with respect to the body, wherein the end portion of the body is configured to releasably grip the pipette tip when the ejector end is oriented in the retracted position, and wherein a movement of the ejector end from the retracted position to the extended position is configured to eject a gripped pipette tip from the end portion of the body;

an adjustment device configured to adjust the extended position of the ejector end with respect to the body;

a lock device configured to selectively inhibit operation of the adjustment device to adjust the extended position of the ejector end; and a link member, wherein the adjustment device adjustably couples the ejector member relative to the link member to adjust the extended position of the ejector end, wherein the lock device is configured to substantially prevent operation of the adjustment device from adjusting the extended position by substantially preventing a relative rotation of the link member with respect to the body.

2. The pipette of claim 1, wherein the lock device is configured to be coupled to the link member to substantially prevent operation of the adjustment device from adjusting the extended position by substantially preventing a relative rotation of the link member with respect to the body, and wherein the lock device is configured to be uncoupled from the link member to allow operation of the adjustment device by permitting a relative rotation of the link member with respect to the body.

3. The pipette of claim 1, wherein an interface between the adjustment device and the link member is configured to removably couple the ejector member with respect to the link member.

4. The pipette of claim 3, wherein the interface is configured to inhibit a rotational movement of the adjustment device with respect to the link member.

5. The pipette of claim 1, wherein the lock device comprises an actuator member configured to be pressed to move the ejector end from the retracted position to the extended position to eject the gripped pipette tip from the end portion of the body.

6. The pipette of claim 1, wherein the adjustment device includes a threaded portion configured to engage a threaded portion of the ejector member, wherein an adjustment rotation of the adjustment device relative to the ejector member is configured to adjust the extended position of the ejector end with respect to the body.

7. The pipette of claim 1, wherein the adjustment device includes at least one stop configured to limit an adjustment of the extended position of the ejector end with respect to the body.

8. The pipette of claim 1, wherein the lock device is configured to be coupled with respect to the body to permit a translation of the lock device with respect to the body and/or inhibit a rotation of the lock device with respect to the body.

9. A pipette for use with a pipette tip, the pipette comprising:

a body including an end portion;

an ejector member including an ejector end configured to reciprocate between a retracted position and an extended position with respect to the body, wherein the end portion of the body is configured to releasably grip the pipette tip when the ejector end is oriented in the retracted position, and wherein a movement of the ejector end from the retracted position to the extended position is configured to eject a gripped pipette tip from the end portion of the body;

a link member;

an adjustment device attached to the link member, the adjustment device including a threaded portion configured to engage a threaded portion of the ejector member, wherein an adjustment rotation of the adjustment device relative to the ejector member is configured to rotate the link member and adjust the extended position of the ejector end with respect to the body; and a lock device configured to be coupled to the link member to substantially prevent the adjustment rotation of the adjustment device by substantially preventing a relative rotation of the link member with respect to the body, and wherein the lock device is configured to be uncoupled from the link member to allow the adjustment rotation of the adjustment device by permitting a relative rotation of the link member with respect to the body.

10. The pipette of claim 9, wherein an interface between the adjustment device and the link member is configured to removably couple the ejector member with respect to the link member.

11. The pipette of claim 9, wherein the lock device comprises an actuator member configured to be pressed to move the ejector end from the retracted position to the extended position to eject the gripped pipette tip from the end portion of the body.

12. The pipette of claim 9, wherein the adjustment device includes at least one stop configured to limit an adjustment of the extended position of the ejector end with respect to the body.

13. The pipette of claim 9, wherein the lock device is configured to be coupled with respect to the body to permit a translation while inhibiting a rotation of the lock device relative to the body.

* * * * *